US010168097B2

(12) United States Patent
Cerciello

(10) Patent No.: US 10,168,097 B2
(45) Date of Patent: Jan. 1, 2019

(54) PLANT FOR CONTINUOUSLY DRYING A COATED FILM

(75) Inventor: Antonio Cerciello, Piacenza (IT)

(73) Assignee: NORDMECCANICA S.P.A., Piacenza (IT)

( * ) Notice: Subject to any disclaimer, the term of this patent is extended or adjusted under 35 U.S.C. 154(b) by 870 days.

(21) Appl. No.: 13/979,158

(22) PCT Filed: Jan. 10, 2012

(86) PCT No.: PCT/IB2012/050122

§ 371 (c)(1),
(2), (4) Date: Oct. 22, 2013

(87) PCT Pub. No.: WO2012/095791

PCT Pub. Date: Jul. 19, 2012

(65) Prior Publication Data

US 2014/0033564 A1 Feb. 6, 2014

(30) Foreign Application Priority Data

Jan. 11, 2011 (IT) ..... PC2011A0001

(51) Int. Cl.
*F26B 13/00* (2006.01)
*F26B 13/14* (2006.01)
(Continued)

(52) U.S. Cl.
CPC ..... *F26B 13/14* (2013.01); *F26B 13/10* (2013.01); *F26B 21/004* (2013.01)

(58) Field of Classification Search
CPC ..... F26B 13/10; F26B 13/14; F26B 21/004; F26B 13/104; F26B 23/022; B41F 23/0426
(Continued)

(56) References Cited

U.S. PATENT DOCUMENTS 2,700,226 A * 1/1955 Dungler ..... D06C 7/00 34/656
3,324,570 A * 6/1967 Flaith ..... B41F 23/0426 242/615.11
(Continued)

FOREIGN PATENT DOCUMENTS

CN 2516344 Y 10/2002
CN 101206412 A 6/2008
(Continued)

OTHER PUBLICATIONS

English translation of Chinese Search Report issued in the corresponding CN application.
(Continued)

*Primary Examiner* — Kenneth Rinehart
*Assistant Examiner* — Bao D Nguyen
(74) *Attorney, Agent, or Firm* — Young & Thompson

(57) ABSTRACT

Disclosed is a plant for continuously drying a coated film including a cavity (3) with a first open end (3*a*) through which a film (F) enters and a second open end (3*b*) through which the dried film exits, a plurality of rollers (7) for supporting the film inside the cavity (3), a feed and extraction system (10) adapted to feed a flow of air to a first blowing element (9), adapted to direct a flow of air onto the surface of the coated film (F), and to extract a flow of air from the cavity (3) through a suction element (27, 28), characterized in that it includes a second blowing element (11) fed by the feed and extraction system (10), adapted to direct a flow of heated air onto the opposite surface of the film.

17 Claims, 4 Drawing Sheets

(51) Int. Cl.
*F26B 13/10* (2006.01)
*F26B 21/00* (2006.01)

(58) Field of Classification Search
USPC ..... 34/620
See application file for complete search history.

(56) References Cited

U.S. PATENT DOCUMENTS 3,434,225 A 3/1969 Knibiehly
3,525,164 A 8/1970 Brown
3,718,983 A 3/1973 Crowell
3,900,959 A * 8/1975 Breschi ..... F26B 3/283 219/388
4,286,392 A 9/1981 Viland
4,785,986 A * 11/1988 Daane ..... F26B 13/104 242/615.11
4,936,025 A * 6/1990 Heikkila ..... F26B 3/283 34/420
5,749,164 A * 5/1998 Bowden ..... F26B 13/104 34/641
2004/0064967 A1* 4/2004 Birgersson ..... D21F 5/18 34/451
2004/0149730 A1 8/2004 Hayashi et al.
2009/0241365 A1* 10/2009 Taguchi ..... F26B 13/10 34/389

FOREIGN PATENT DOCUMENTS

GB 695 582 8/1953
JP 2008231161 A 10/2008

OTHER PUBLICATIONS

International Search Report dated Apr. 23, 2012, corresponding to PCT/IB2012/050122.

* cited by examiner

PLANT FOR CONTINUOUSLY DRYING A COATED FILM

BACKGROUND OF THE INVENTION

Field of the Invention

The present invention relates to a plant for continuously drying a coated film, and in particular a film for laminates coated with an adhesive layer.

Description of the Related Art

Laminated films machines are generally produced using machines in which a first layer of film, for example made of plastic, paper aluminium or the like, is laminated with at least a second layer of film by means of a thin layer of glue which is applied evenly to one of said two layers before lamination.

In many applications, these films are laminated using an adhesive or adhesive mixture which contains a certain percentage of solvent, such as ethyl acetate or the like.

This solvent has the task of lowering the viscosity of the adhesive to facilitate application, which takes place continuously on a layer of film fed at high speed, generally even reaching 6-7 meters per second (m/s).

However, once the adhesive has been applied to the surface of one of the two films, the solvent must be eliminated to return the adhesive to the (higher) ideal viscosity to carry out lamination of the two layers.

For this purpose, the film to which the adhesive is applied is made to pass through a drying plant (known as "oven" in the sector), in which, through heating, evaporation of the solvent from the layer of adhesive is facilitated.

In some plants, drying takes place by means of heated calenders on which the film is wound, taking it to a temperature such as to cause rapid volatilization of the solvent present in the adhesive.

The fumes are then drawn off and evacuated, after treatment to purify and filter the air if required.

However, these systems have considerable overall dimensions, due to the presence of calenders of substantial size, and involve high running costs, due to the large quantities of energy required to heat the calenders and keep them hot and to remove fumes.

In other prior art systems drying takes place using a flow of heated air which is first directed at the film and subsequently drawn off to be purified and evacuated.

The present invention relates to this second type of plants.

An example of prior art plant is described in the Italian patent application No. 0001364123 by the same applicant.

The plant in question comprises a substantially tunnel-shaped structure provided with a plurality of rollers adapted to support and convey the film, and a plurality of blowers, situated above the film, adapted to convey a flow of hot air onto the surface of the film to which adhesive has been applied to evaporate the solvent evacuated through specific suction systems.

However prior art devices of this type have some disadvantages.

In fact, feeding the flow of air from above, i.e. directly onto the layer of adhesive deposited on the film, means that the outer (upper) surface of said layer of adhesive dries before the rest of the thickness, thereby preventing the solvent contained in the mass of adhesive below said outer surface from escaping.

Another limitation found in these prior art devices is the difficulty in alignment of the various rollers to ensure that the film is conveyed in a manner as rectilinear as possible inside the oven.

In fact, small angular variations in the position of the various rollers to guide and support the film are sufficient to cause noteworthy deviations of the film, which in turn cause creasing and curling of the same film.

In general, the greater the number of rollers present is (with the same length of the section travelled by the film), the more difficult it is to limit this phenomenon.

There are also known drying plants that have no rollers to guide and support the film. In these plants, the film is driven by two rollers (or pairs of counter-rotating rollers) situated at the entrance and at the exit of the plant, while on the inside it is supported by jets of air delivered from blowers located both above and below relative to said film.

In this way, by appropriately balancing the flows and the velocities of the jets of air it is possible to maintain the film suspended at a certain height inside the plant. These systems, known in the sector as "floating", also have some disadvantages. In particular, in these plants the pressures that are created above and below the film must be maintained balanced at all times, i.e. the flows of the upper and lower jets of air must be maintained balanced.

Moreover, as is easily understood, there must always be a minimum lower pressure sufficient to counteract the weight of the same film and to support it; therefore, the lower jets of air can never be completely eliminated.

In this way, if the lower part of the film does not require to be heated, or if this heating could be damaging for some materials, these plants would have to provide separate heating systems for the two flows of air, upper and lower.

This leads to increased energy consumption to move and heat the air and increased plant complexity.

SUMMARY OF THE INVENTION

In this context, an object of the present invention is to propose a plant for continuously drying a coated film, in particular a film to which adhesive is applied, which overcomes the problems of prior art indicated above.

In detail, the object of the present invention is to propose a plant for continuously drying a coated film that enables, when necessary, heating of the lower part of the layer of coated film, so as to prevent the outer surface of the layer of adhesive from drying before the rest of the thickness of said layer of adhesive.

More in detail, the object of the present invention is to provide a plant for continuously drying a coated film that enables the layer of coated film to be heated both above and below, maintaining substantially constant the flow of air used relative to prior art systems provided with supporting rollers and blowers situated only in the upper part.

A further object of the present invention is that of being able to regulate the quantity of heat delivered from above and below and, if necessary, to be able to exclude at least the heat from below.

Another object of the present invention is to produce a plant for continuously drying a coated film which has reduced overall dimensions, in any case not exceeding those of prior art plants.

The technical object indicated and the objects specified are substantially achieved by a plant for continuously drying a coated film, comprising a cavity with a first open end through which a film enters and a second open end through which the dried film exits, a plurality of rollers for supporting said film inside said cavity, a feed and extraction system adapted to feed a flow of air towards first blowing means, adapted to direct a flow of air onto the surface of the coated film, and to extract a flow of air from said cavity (3) through suction means, characterised in that it includes second blowing means fed by said feed and extraction system, adapted to direct a flow of heated air onto the opposite surface of said film.

Said second blowing means therefore enable heating of the layer of film also in the lower part so as to prevent or limit drying of the outer surface of the coating layer. Said second blowing means can also be activated separately from the first blowing means, enabling them to be used only when required and with films made of compatible materials.

BRIEF DESCRIPTION OF THE DRAWING FIGURES

Further characteristics and advantages of the present invention will be more apparent from the description, provided by way of non-limiting example, of a preferred but not exclusive embodiment of a plant for continuously drying a coated film, as illustrated in the accompanying drawings, wherein.

Figure 1:
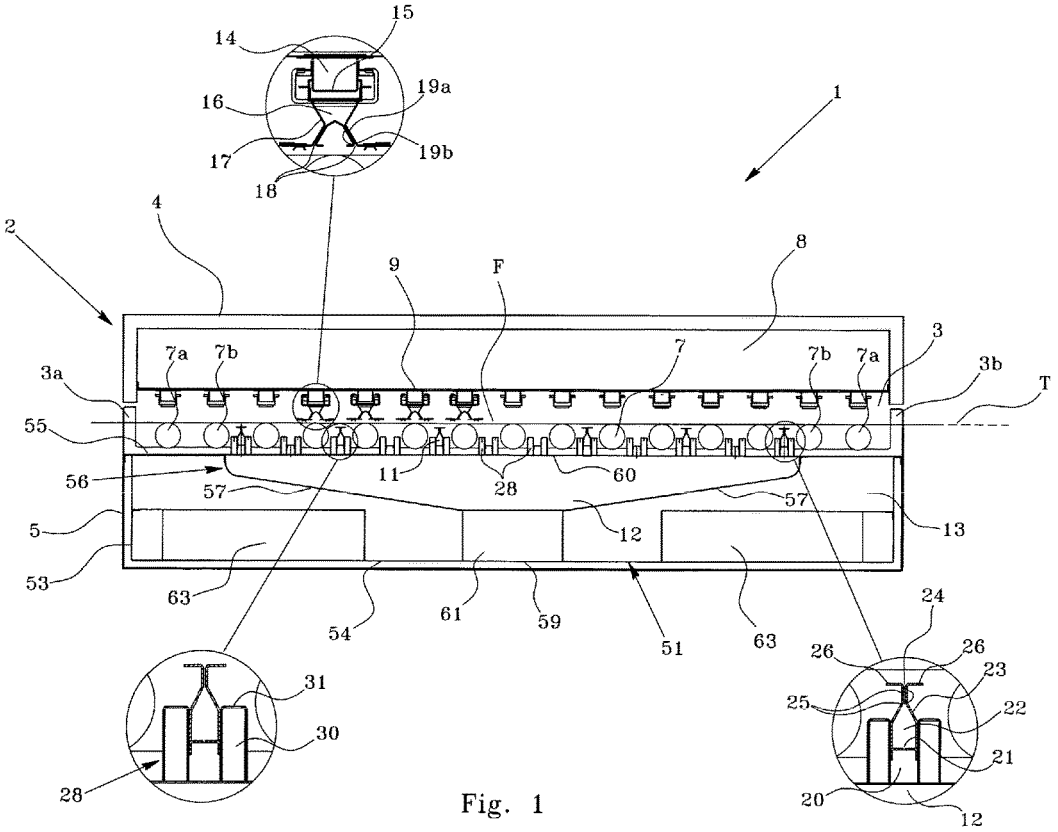
FIG. 1 is a sectional side view of a plant according to the invention.
Figure 3A:
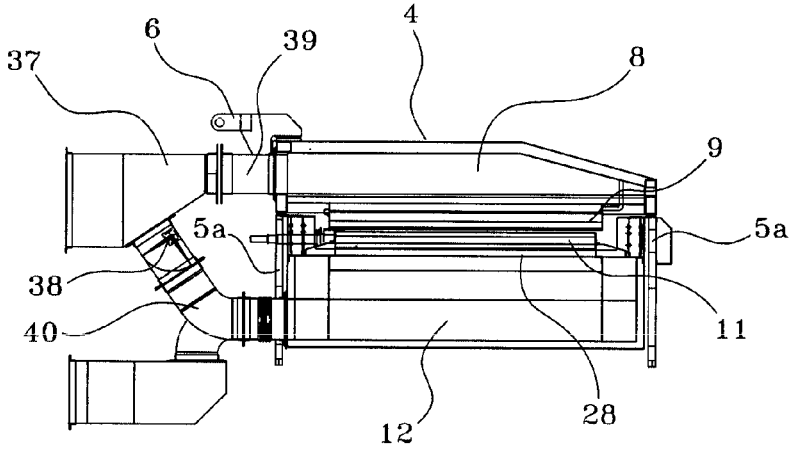
Figure 3B:
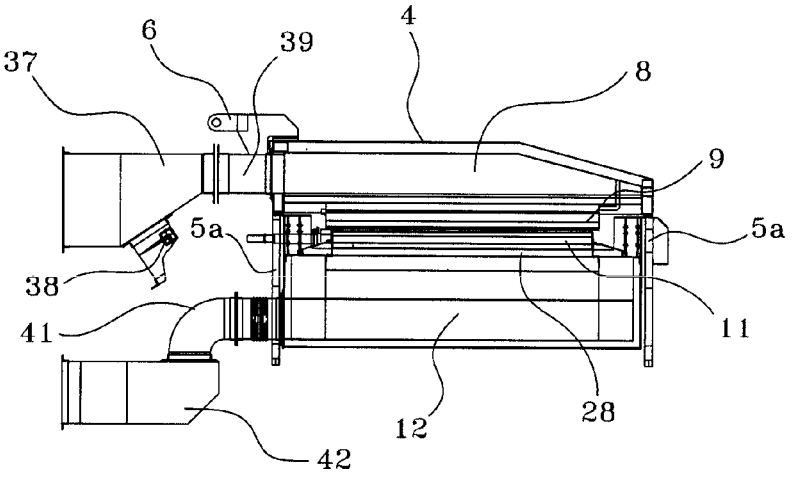
Figure 4:
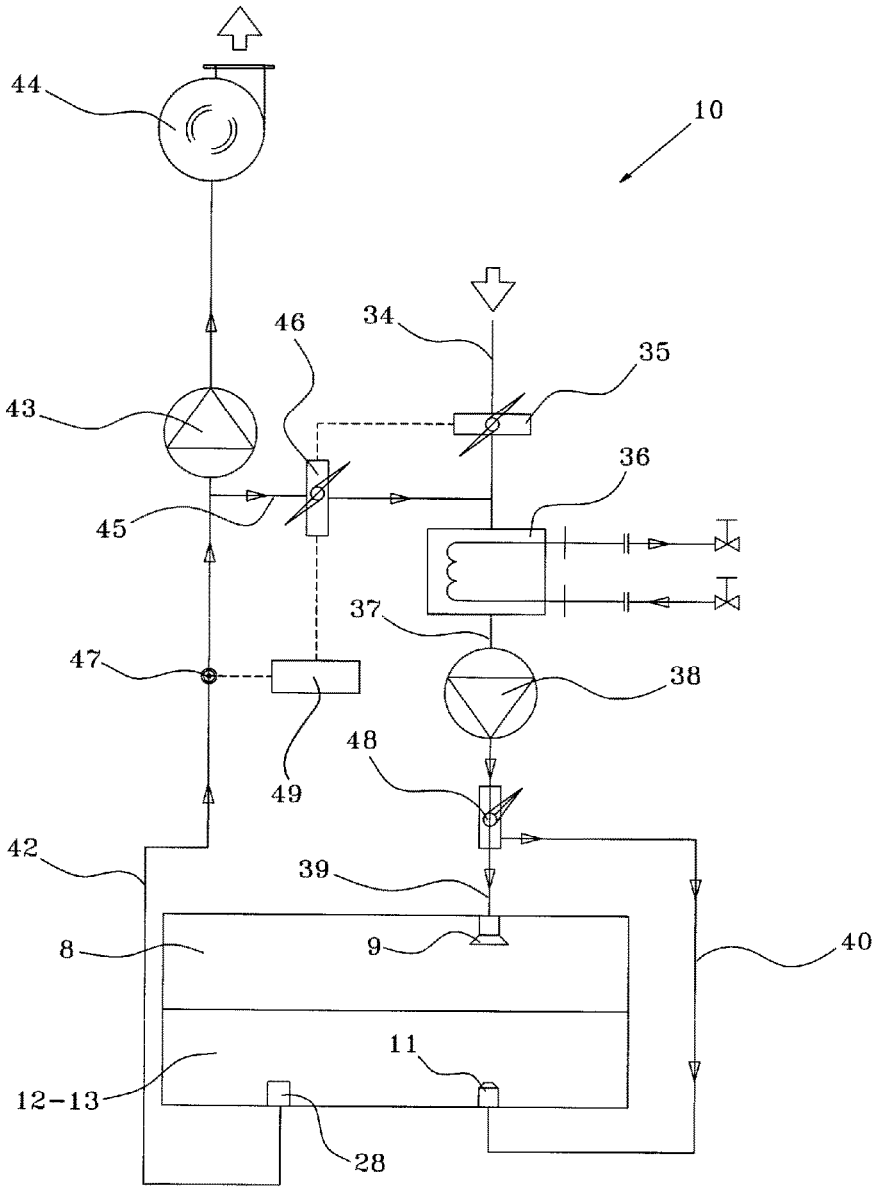

FIGS. 3*a* and 3*b* are two sectional front views of the plant of FIG. 1;

FIG. 4 is a schematic view of the circuit of the air feed and extraction system.

DETAILED DESCRIPTION OF THE INVENTION

Figure 2:
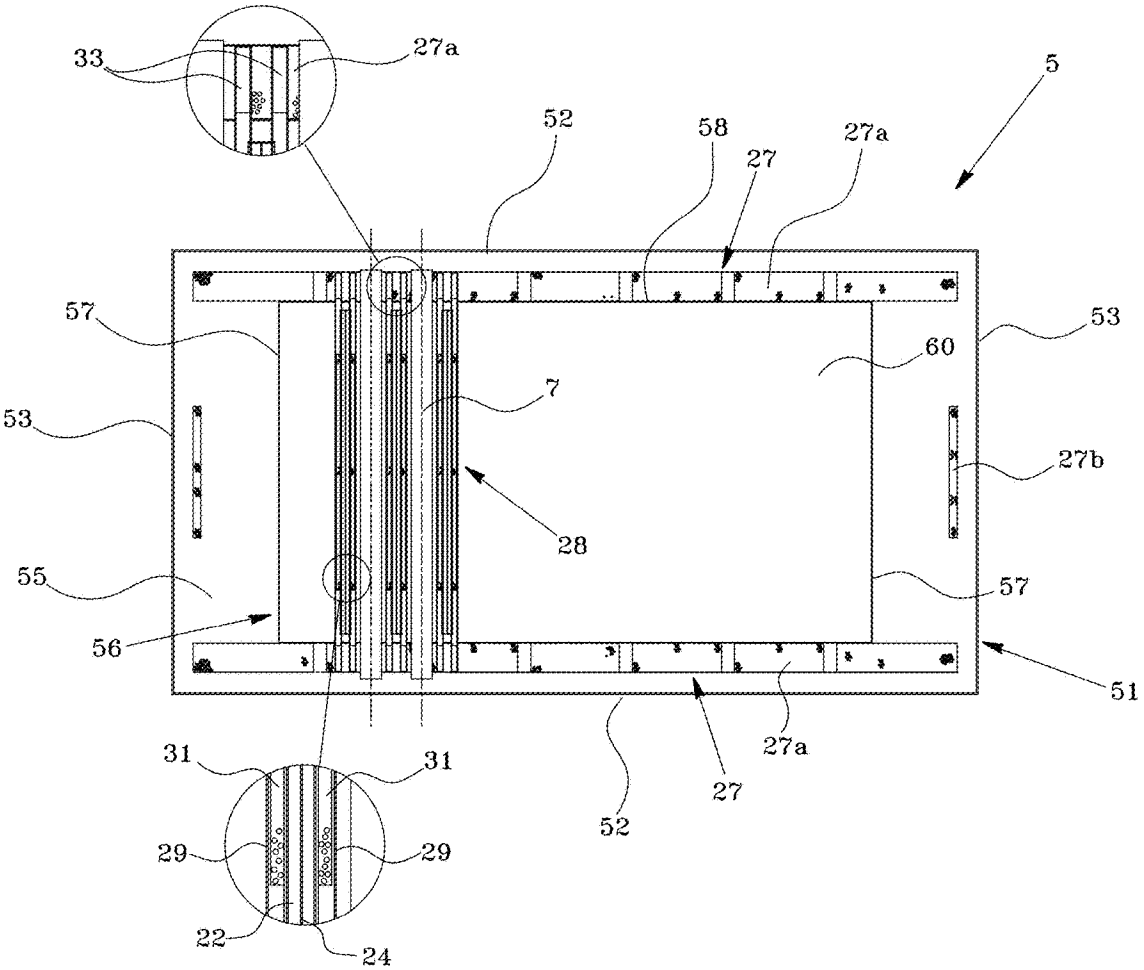
FIG. 2 is a sectional top view of the plant of FIG. 1.

With reference to the accompanying FIGS. 1, 2 and 3, the plant for continuously drying a coated film, indicated as a whole with 1, comprises a structure 2 defining a cavity 3 inside which a coated film F to be dried is guided.

Said film F can, for example, be a film for laminates in plastic, paper, aluminium or other materials, coated with a layer of material from which a certain volatile percentage contained therein must be evaporated, but also a laminated film composed of a plurality of layers of film.

The cavity 3 in the detail has a first open end 3*a* through which the film F enters and a second open end 3*b* through which said film exits after drying has been completed.

Instead, the structure 2 comprises a first upper portion 4 and a second lower portion 5, mutually overlapping, between which said cavity 3 is comprised.

Said first upper portion 4 is movable away from and towards the second lower portion 5 to enable cleaning and maintenance operations of the various devices present in the cavity 3.

In detail said upper portion 4 is hinged along one side to said second portion 5, by means of hinges 6, with the possibility of rotation from an idle open position, in which easy access to the devices of the cavity 3 is enabled, to a closed operating position, in which it is substantially overlapping the second portion 5 to form said cavity 3.

Inside the cavity 3, fixed on the shoulders 5*a* of the lower part 5, there are provided a plurality of motorized rollers 7 to support the film F inside the cavity during drying, from the first end 3*a* through which the film enters towards the second end 3*b* through which the film exits.

In detail said rollers are motorized so as to rotate with a peripheral speed equal to that of the film; this prevents relative rubbing between the surface of the rollers and the lower surface of the film F, i.e. the uncoated surface, when these come into contact.

Preferably said rollers 7 are arranged equidistant from one another for the entire length of the cavity 3, between said end 3*a* and said end 3*b*.

The first upper portion 4 comprises a first hollow box-shaped element defining a first chamber 8 into which a certain flow of pressurized air, preferably heated, is fed by a feed and extraction system, indicated as a whole with 10 in FIG. 4, and better described below.

In detail, said flow of air is fed at least onto the upper surface of the film, i.e. the coated surface, to dry the film or to evaporate from the coating material a certain percentage of a volatile substance contained therein.

For example, if said coating material is an adhesive containing solvent, a certain percentage of said solvent is evaporated by heating and subsequently drawn up and extracted.

For this purpose, first blowing means adapted to direct a flow of air, preferably heated, onto the surface of the coated film, are mounted on said first upper portion 4.

In detail, said first means comprise a plurality of upper blowers 9 facing said cavity 3 and fed with air from the first chamber 8 of the first upper portion 4.

Preferably said upper blowers 9 are situated at each roller 7; in practice, each blower 9 is aligned with a corresponding roller 7 positioned below the film F.

In this way, it is possible to balance the force exerted by the pressure of the flow of air that is directed downwards onto the coated surface of the film, preventing excessive deviation of its trajectory.

According to the invention second blowing means are also provided, adapted to direct a flow of air onto the lower surface of the film F, i.e. the uncoated surface, when this is required.

Said second means comprise at least one lower blower 11 mounted on the second lower portion 5 of the structure 2.

Preferably, a plurality of lower blowers 11 are provided, arranged between each roller 7 and the adjacent one, and situated at a height just below the ideal trajectory of the film, indicated with T in FIG. 1.

Even more preferably, between the first two rollers and between the last two rollers 7*a* and 7*b* situated in proximity of the openings 3*a* and 3*b*, no blower 11 is provided, in to prevent creating turbulence in the areas in which the film enters and exits, which could cause solvent to emerge through said openings, as well as excessive fluttering of the same film.

It must be noted that in FIG. 2, for ease of representation, only some of the lower blowers 11 and of the rollers 7 are shown.

Said lower blowers 11 are also fed by the feed and extraction system 10 through the second lower portion 5.

In detail, said lower portion 5 comprises a hollow box-shaped element provided with a plurality of inside walls such as to define a second chamber 12 and a third chamber 13, both connected to the suction and extraction system 10.

Said second lower portion 5 is described in more detail with reference to FIGS. 1 and 2.

In particular, said second lower portion 5 comprises a second box-shaped element 56 defined by two pairs of lateral walls 57 and 58, by a lower surface 59 and an upper surface 60.

Said second box-shaped element 56 is in turn contained inside a third hollow box-shaped element 51 defined by two pairs of lateral walls 52 and 53, by a lower surface 54 and an upper surface 55, which coincides with the outer contour of the second lower portion 5.

In detail, said second box-shaped element has smaller plan dimensions relative to that of the first box-shaped element and is positioned so that the two upper surfaces 55 and 60 are placed at the same level and are substantially coincident. In practice, there are defined inside the third box-shaped element two volumes, separate from each other, which coincide with the second chamber 12 and the third chamber 13.

The second chamber 12 in particular is defined by the volume contained inside the second box-shaped element 56, while the third chamber 13 is defined by the difference in volume between the third box-shaped element 51 and the second box-shaped element 56.

Preferably, the lateral walls 57 of the second box-shaped element 56 are inclined and converging towards the centre so as to give the second box-shaped element a funnel shaped structure that enables better air distribution towards the blowers 11. Connection of said second box-shaped element, i.e. of the second chamber 12, with the feed and extraction system takes place through an inlet channel 61, also isolated from the third chamber 13, facing a lateral wall 52 of the third box-shaped element 51.

Extraction from the third chamber 13 instead takes place through a pair of mouths 63 positioned on a lateral wall of the third box-shaped element 51, and in particular on the same lateral wall 52.

Said second chamber 12 therefore feeds a certain flow of pressurized air, preferably heated, into the cavity 3 through the lower blowers 11; a vacuum is instead created in the third chamber 13 by said feed and extraction system 10 to draw off both the flow of air input by the upper blowers 9, and the flow of air input by the lower blowers 11, after it has performed its drying action on the film.

In this way it is possible to remove from the cavity 3 the evaporated fraction of the coating, for example the solvent, if this is an adhesive, and send it towards recirculation or evacuation and purification systems.

The upper 9 and lower 11 blowers are described more in detail with reference to the details of FIG. 1.

The upper blower 9 comprises a first hollow bar 14 having a fluid connection to the first chamber 8 of the upper portion 4, which extends transversely at least for a length equal to that of the film F, and into which the flow of pressurized air is fed.

Preferably, said bar has a substantially quadrilateral shaped section, so as to define an upper face provided with openings for fluid connection with the chamber 8, and a lower face 15 facing the coated surface of the film F.

On said lower face 15 there are produced one or more openings which substantially extend over the full length of said bar, and which enable the passage of air towards an upper nozzle 16.

Said upper nozzle 16 is removable from the bar 14 for cleaning operations or for replacement with another of different shape.

The detail of FIG. 1 shows an upper nozzle 16 according to a preferred, but non-limiting, embodiment.

In detail, said nozzle also comprises a tubular structure with a substantially trapezoidal section provided with two converging walls 17 which substantially extend over the same width as the hollow bar 14.

In the lower part, i.e. in the part facing the coated surface of the film F, said tubular structure is provided with two passages 18 through which the air is expelled and directed onto the surface of the film.

Just as for the walls 17, said passages 18 substantially extend over the same width as the hollow bar 14, thus forming an air knife having at least the same width as the film F to be dried.

To improve the efficiency and the direction of the flow of air, there are provided at the two passages 18 two pairs of blades 19*a* and 19*b*, facing each other and spaced apart by a few millimeters (2-3 mm), which force the flow of air passing through them, facilitating formation of the air knife.

Preferably said pair of blades are inclined relative to a vertical direction and in particular the pair 19*a* and the pair 19*b* are divergent relative to said vertical direction.

This enables the creation of two pressurized forces, which act on the surface of the film F maintaining it closely in contact with the roller 7 below, which is aligned precisely with the nozzle 16.

Similarly to the upper blowers 9, the lower blowers 11 also comprise a hollow bar 20 having a fluid connection to the second chamber 12 of the lower portion 5, i.e. the portion fed with pressurized air by the feed and extraction system 10.

Preferably, said hollow bar 20, which substantially extend over the full width of the second chamber 12 (or of the second box-shaped element 56), has a substantially quadrilateral shaped section, so as to define a lower face provided with one or more openings for fluid connection with the second chamber 12, and an upper face 21 facing the lower surface of the film F, i.e. the uncoated surface.

Said upper face 21 is perforated substantially for the whole of its extension, i.e. for the whole of the length of said bar, to enable the passage of air towards a lower nozzle 22, shown in the detail of FIG. 1 according to a preferred, but non-limiting, embodiment.

It must be noted that in FIG. 1, for ease of representation, only some of the upper 16 and lower 22 nozzles are represented.

Just as for the upper nozzle, said lower nozzle is removable from the bar to enable cleaning operations or for replacement with another of different shape.

In detail, said nozzle comprises a tubular structure with a substantially triangular or trapezoidal section provided with two converging walls 23 which substantially extend over the same width as the hollow bar 20.

In the upper part, i.e. the part facing the lower surface of the film F, said tubular structure is provided with a passage 24 through which the air is expelled and directed onto the lower surface of the film.

Just as for the walls 23, said passage substantially extends over the same width as the hollow bar 20 thus forming an air knife having at least the same width as the film F to be dried.

To improve the efficiency and the direction of the flow of air, there is provided at the passage 24 a pair of blades 25, facing each other and spaced apart by a few millimeters (2-3 mm), which force the flow of air passing through them, facilitating formation of the air knife.

Preferably said blades are arranged along a vertical direction, i.e. substantially perpendicular to the film F, so that the flow of air does not generate transverse forces thereon.

At said blades, there is preferably also provided a pair of fins 26 arranged substantially parallel to the ideal direction of movement of the film F.

Said fins, being placed at a distance of a few millimeters (10-15 mm) from the lower surface of the film, i.e. from the trajectory T, enable the formation of turbulence, which delays detachment of the flow of air from the surface thereof, increasing the contact time and thus also optimizing heating.

On the second lower portion 5 there are also provided suction means, connected to the third chamber 13 of the lower portion 5, adapted to draw a certain flow of air from the cavity 3 in order to evacuate the volatile portion of the coating of the film F.

In detail, said suction means comprise first suction means, indicated as a whole with 27, and second suction means, indicated as a whole with 28.

Said first suction means comprise a plurality of perforated plates 27, situated at the upper surface 55 of the lower portion 5, which place in communication the vacuum chamber 13 and the cavity 3.

Even more in detail, said perforated plates 27 are provided at the lateral perimeter of the lower portion 5, i.e. in the area in which a vacuum is created by the third chamber 13.

Preferably, there are provided at least one pair of perforated plates 27*a* situated along the lateral edges of the lower portion 5 which substantially extend over the full length of said lower portion 5.

In this way, after striking the coated surface of the film, the flow of heated air is diverted laterally and is drawn through said perforated plates 27*a* to be subsequently recirculated or purified and evacuated.

Preferably, there is provided a further pair of perforated plates 27*b* at the head ends of the lower portion 5.

In this way, it is possible to increase the flow of air at the openings 3*a* and 3*b* of the cavity 3 and prevent a certain quantity of air loaded with volatile substances (solvents or the like) from emerging through said openings due to the turbulence that forms inside the cavity.

The second suction means 28 instead comprise at least one suction pipe 29 situated below the film and arranged between the lower blowers 11 to remove at least in part the flow of hot air directed by said lower blowers onto the lower surface of the film.

In detail, said suction pipe 29 comprises a hollow bar 30, arranged substantially parallel to said lower blowers 11, which substantially extends over the full transverse width of the lower portion 5.

Preferably, said hollow bar 30 has a section with a substantially quadrilateral shape so as to define an upper face 31 facing the lower surface of the film F, i.e. the uncoated surface.

Said upper face 31 is at least partly perforated, approximately over the same width as the film F, to enable the air to be drawn from the cavity 3 in the area underneath said film F.

Moreover, said hollow bar 30 has a fluid connection to the third chamber 13 in the lower part, at the lateral ends, i.e. at the portion overlapping the perforated plates 27*a*.

In practice, in the lower surface 32 of said bar, at the lateral ends, there are produced two openings 33 which place the third chamber 13 in communication with the hollow bar 29 to enable suction (FIG. 2).

In the remaining portion, the lower surface 32 is instead isolated from the second chamber 12 fed with pressurized air.

Preferably, there is provided a plurality of suction pipes 29, situated against the lower blowers 11 and arranged substantially parallel thereto.

Even more preferably, there are provided a pair of suction pipes 29, arranged at the side of each blower 11 and coupled therewith.

In this way, each suction pipe 29 captures part of the flow of air that emerges through the lower nozzle 22 and which, due to the presence of the fins 26, expands along two opposite directions substantially parallel to the film.

In fact, when the turbulent phase against the film comes to an end, said flow detaches and is drawn through said suction pipe 29.

With reference to FIG. 4, there is schematically shown the feed and extraction system indicated as a whole with 10.

Said feed and extraction system, indicated as a whole with 10, comprises an inlet duct 34 for the entry of air at ambient temperature, on which there is provided a first damper 35 to regulate the flow of fresh air entering.

Downstream of the damper 35 there is provided a heat exchanger 36, for example a battery of radiators fed with diathermic oil, to heat the flow of air directed towards the cavity 3.

Downstream of the heat exchanger 36 there is provided a fan 38 which, by generating a vacuum in the first duct, enables air to be drawn in from the outside and, through a second duct 37, sent towards the first chamber 8 of the upper portion 4 and towards the second chamber 12 of the lower portion 5.

In detail, there is provided a second damper 48, or the like, adapted to manage the flows of air towards the respective first and second chamber 8 and 12.

Downstream of the second damper 48 there are in fact provided two ducts 39 and 40 respectively leading to the first chamber 8 of the upper portion 4 and to the second chamber 12 of the lower portion 5 through the duct 61 (FIGS. 2 and 3).

By regulating opening of the damper 48 it is thus possible to throttle entry to the respective chambers according to need.

The air is then sent by the two chambers, through the respective upper 9 and lower 11 blowers, to the cavity 3 for drying of the film.

As already mentioned, a vacuum is created in the third chamber 13 to draw off the air loaded with volatile substances evaporated from the coating of the film.

On the wall 52 of the second portion 5, which defines the outer volume of the third chamber 13, there are provided two suction mouths 63 which lead into the same number of suction ducts 41 which then merge into a single suction duct 42 (FIGS. 3*a* and 3*b*.

On said duct 42 there is provided a fan 43 which creates the vacuum inside the third chamber 13 and enables the air to be drawn off and sent to expulsion and purification devices 44.

Preferably, on the duct 42, upstream of the fan 43, there is provided a connection of a further duct 45 for recirculation of a portion of the air drawn off, still sufficiently hot, in order to recover at least part of the thermal energy.

Said duct 45 is connected at the exit to the inlet duct 34 downstream of the heat exchanger 36.

Entry of the recirculated air is controlled through a third damper 46 situated on said duct 45.

As a function of the flow recirculated by the third chamber 13, the flow of fresh air required is regulated through the first damper 35.

A sensor 47, situated on the suction duct 42, measures the level of volatile substances present in the air and sends the information to a control system 49 which manages opening of the third damper 46 and of the first damper 35 to balance the flow of recirculated air and the flow of fresh air, to maintain said level of volatile substances below a certain pre-established threshold.

Through the present invention it is therefore possible to propose a plant for continuously drying a coated film which enables heating of the layer of coated film also in the lower part so as to prevent the outer surface of the layer of adhesive from drying before the rest of the thickness of said layer of adhesive.

This solution is very advantageous, for example, in the case in which the film is made of a good heat conducting material, such as aluminium or other metals.

The plant thus configured also enables use of the same flow of air, and consequently also the same quantity of thermal energy, used in prior art systems provided with blowers situated only in the upper part.

In the case in which the feed of air to the lower part is not necessary, it is possible, through the damper 48, to completely exclude the lower blowers 11 and to direct the total flow only to the upper blowers 9.

Through the particular structure of the lower portion 5, i.e. of the two box shaped elements 51 and 56, it is possible to obtain a system with substantially the same overall dimensions relative to prior art devices provided with air feed only in the upper part.

Again through the structure of the two box-shaped elements 51 and 56 which define the respective chambers 12 and 13, it is possible to arrange in the area below the film both the blowing devices 11 and the suction devices 28, coupling them, with the benefits previously described.

The plant for continuously drying a coated film, as described and illustrated, is susceptible to numerous modifications and variants all included in the scope of the inventive concept; moreover, all details can be substituted by other technically equivalent elements.

The invention claimed is:

1. A plant for continuously drying a coated film, comprising:

a structure with a first upper portion and a second lower portion, mutually overlapping, between which a cavity is comprised, said cavity having a first open end through which said film enters and a second open end through which the dried film exits, a plurality of rollers for supporting said film inside said cavity, first blowers feeding a flow of heated air onto a coated surface of film, second blowers feeding a flow of heated air onto an opposite surface of said film, and a suction device extracting a flow of air from said cavity, wherein said first upper portion comprises a first hollow box-shaped element defining a first chamber having a fluid connection with the first blowers, wherein said second lower portion comprises a second hollow box-shaped element provided with a plurality of inside walls to define a second chamber having a fluid connection with the second blowers and a third hollow box-shaped element defining a third chamber having a fluid connection with the suction device, the third hollow box-shaped element surrounding the second box-shaped element, and wherein the suction device comprises:

a plurality of perforated plates for communicating the third chamber and the cavity, a long dimension of said perforated plates being located parallel to the lateral edges of an upper surface of the second lower portion and extending over a length of the second lower portion so that said perforated plates can draw the flow of heated air blown from the first blowers that diverted laterally after striking the upper surface of the film, and suction pipes located below the film and arranged between the second blowers to draw at least a part the flow of heated air blown from said second blowers onto the lower surface of the film, said suction pipes comprise hollow bars arranged parallel to the second blowers and extending over the full transverse width of the second lower portion, said hollow bars configured to have a fluid connection with the third chamber only in the lower part of the hollow bar, at the lateral ends of the lower part of the hollow bar, and at portions of the lateral ends of the lower part of the hollow bar that overlap the perforated plates, the plant further comprising a feed and extraction system for feeding heated pressurised air in the first chamber and in the second chamber, and for creating a vacuum in the third chamber, so that the flows of air from the first blowers and the second blowers are drawn off from the cavity through the third chamber by the feed and extraction system after the first and second blowers have performed their drying action on the film.

2. The plant according to claim 1, wherein said second blowers can be activated selectively, separately from the first blowers.

3. The plant according to claim 2, wherein said second blowers comprise a plurality of lower blowers mounted on the second lower portion, said lower blowers comprising:

a hollow bar, having a fluid connection to the second chamber, which extends over a full width of said second chamber and having at least one perforated face, and a lower nozzle mounted on said hollow bar and receiving air from the hollow bar via the perforated face.

4. The plant according to claim 3, wherein said lower nozzle comprises:

a tubular structure having a polygonal cross-section provided with two converging walls which extend over the same width as the hollow bar, a passage being produced between said walls through for expelling and directing the air onto the lower surface of the film.

5. The plant according to claim 1, wherein said second lower portion comprises:

the second box-shaped element, and a third box-shaped element, containing the second box-shaped element, which coincides with an outer contour of the second lower portion, the second chamber being defined by a volume inside the second box-shaped element, the third chamber being defined by a difference in volume between the third box-shaped element and the second box-shaped element.

6. The plant for continuously drying a coated film according to claim 5, wherein said second blowers comprise a plurality of lower blowers mounted on the second lower portion, said lower blowers comprising:

a hollow bar, having a fluid connection to the second chamber, which extends over a full width of said second chamber and having at least one perforated face, and a lower nozzle mounted on said hollow bar and receiving air from the hollow bar via the perforated face.

7. The plant according to claim 5, wherein said feed and extraction system comprises:

at least one inlet duct for an entry of air from outside, a heat exchanger for heating the air, a first fan that enables air to be drawn in from outside and directed towards the first chamber and towards the second chamber, and a regulator regulating a passage of air towards said second chamber.

8. The plant according to claim 1, wherein said second blowers comprise a plurality of lower blowers mounted on the second lower portion, said lower blowers comprising:

a hollow bar, having a fluid connection to the second chamber, which extends over a full width of said second chamber and having at least one perforated face, and a lower nozzle mounted on said hollow bar and receiving air from the hollow bar via the perforated face.

9. The plant according to claim 8, wherein said lower nozzle comprises:

a tubular structure having a polygonal cross-section provided with two converging walls which extend over a same width as the hollow bar, a passage being produced between said walls through for expelling and directing the air onto the lower surface of the film.

10. The plant according to claim 8, wherein said feed and extraction system comprises:

at least one inlet duct for an entry of air from outside, a heat exchanger for heating the air, a first fan that enables air to be drawn in from outside and directed towards the first chamber and towards the second chamber, and a regulator regulating a passage of air towards said second chamber.

11. The plant according to claim 1, wherein said feed and extraction system comprises:

at least one inlet duct for an entry of air from outside, a heat exchanger for heating the air, a first fan that enables air to be drawn in from outside and directed towards the first chamber and towards the second chamber, and a regulator that regulates passage of air towards said second chamber.

12. The plant according to claim 11, wherein said regulator comprises a damper adapted to manage the flows of air towards two ducts respectively leading to the first chamber of the first upper portion and to the second chamber of the second lower portion.

13. The plant according to claim 12, comprising a sensor, located on the suction duct, arranged for measuring a level of volatile substances in the air and for sending the information to a control system which manages opening of the damper for balancing the flow of recirculated air and the flow of fresh air, so as to maintain said level of volatile substances below a pre-established threshold.

14. The plant according to claim 1, wherein the third chamber comprises a pair of mouths positioned on a lateral wall of the third hollow-box shaped element, adapted for extraction of air from the third chamber.

15. The plant according to claim 14, wherein the mouths lead into suction ducts which then merge into a further single suction duct provided with a second fan which creates the vacuum inside the third chamber and enables the air to be drawn off.

16. The plant according to claim 15, wherein upstream of the second fan there is provided a connection of a further duct for recirculation of a portion of the air drawn off in order to recover at least part of the thermal energy, said further duct being connected at an exit to an inlet duct and downstream of the heat exchanger and being provided with a further damper for controlling the flow of the recirculated air.

17. The plant according to claim 1, wherein the first upper portion is hinged along one side to the second lower portion by means of hinges, so that said upper portion can rotate from an idle open position, in which easy access to devices of the cavity is enabled, to a closed operating position, in which it overlaps the second portion to form the cavity.

* * * * *